US011845644B2

(12) United States Patent
Ogden

(10) Patent No.: US 11,845,644 B2
(45) Date of Patent: Dec. 19, 2023

(54) FLAVOR INFUSION DISPENSER

(71) Applicant: Micro Matic USA, Inc., Brooksville, FL (US)

(72) Inventor: Daren Ogden, Brooksville, FL (US)

(73) Assignee: MICRO MATIC USA, INC.

( * ) Notice: Subject to any disclaimer, the term of this patent is extended or adjusted under 35 U.S.C. 154(b) by 0 days.

(21) Appl. No.: 17/895,230

(22) Filed: Aug. 25, 2022

(65) Prior Publication Data

US 2023/0067779 A1 Mar. 2, 2023

Related U.S. Application Data

(60) Provisional application No. 63/237,391, filed on Aug. 26, 2021.

(51) Int. Cl.

| | |
|---|---|
| ***B67D 1/00*** | (2006.01) |
| ***B67D 1/14*** | (2006.01) |
| ***B67D 1/08*** | (2006.01) |

(52) U.S. Cl.

CPC ..... *B67D 1/0034* (2013.01); *B67D 1/0857* (2013.01); *B67D 1/1405* (2013.01); *B67D 2001/1483* (2013.01)

(58) Field of Classification Search

CPC .. B67D 1/0034; B67D 1/0857; B67D 1/1405; B67D 2001/1483

See application file for complete search history.

(56) References Cited

U.S. PATENT DOCUMENTS 4,708,266 A * 11/1987 Rudick ..... B67D 1/0051 222/105
4,753,370 A * 6/1988 Rudick ..... B67D 1/0051 222/105

(Continued)

FOREIGN PATENT DOCUMENTS

WO WO 2006/036353 A1 4/2006
WO WO-2006036353 A1 * 4/2006 ..... B67D 1/0021

(Continued)

OTHER PUBLICATIONS

International Search Report and the Written Opinion of the International Searching Authority, dated Nov. 30, 2022, European Patent Office, International Application No. PCT/US2022/041531.

*Primary Examiner* — Paul R Durand
*Assistant Examiner* — Randall A Gruby
(74) *Attorney, Agent, or Firm* — Burr & Forman LLP; Ryan M. Corbett

(57) ABSTRACT

A flavor infusion dispenser is provided. The flavor infusion dispenser may include a refrigeration unit configured to store a beverage container, a beverage tower coupled to the refrigeration unit and configured to transport a beverage from the beverage container, a faucet coupled to the beverage tower and having a handle configured to activate flow of the beverage from the beverage container through the beverage tower, a nozzle coupled to the faucet, at least one flavor container for storing flavoring for the beverage, at least one flavor line coupled to the nozzle and configured to transport flavoring from the at least one flavor container, and a pump configured to pump flavoring from the at least one flavor container to the nozzle via the at least one flavor line. The nozzle may be configured to mix the beverage and the flavoring, and dispense a flavored beverage.

14 Claims, 4 Drawing Sheets

SECTION A-A

(56) References Cited

U.S. PATENT DOCUMENTS

| | | | | | |
|---|---|---|---|---|---|
| 4,856,676 | A * | 8/1989 | Emody | B67D 1/12 | 285/305 |
| 5,000,348 | A * | 3/1991 | Emody | B67D 1/0021 | 222/105 |
| 5,350,082 | A * | 9/1994 | Kiriakides, Jr | G07F 13/10 | 221/96 |
| 5,415,326 | A * | 5/1995 | Durham | B67D 1/005 | 222/145.5 |
| 5,427,276 | A * | 6/1995 | Knuettel, II | B67D 1/0835 | 62/390 |
| 5,456,387 | A * | 10/1995 | Trewhella | B67D 3/0009 | 222/503 |
| 5,549,222 | A * | 8/1996 | Schroeder | B67D 1/005 | 239/432 |
| 5,960,997 | A * | 10/1999 | Forsythe | B67D 1/1293 | 222/129.4 |
| 7,311,224 | B2 * | 12/2007 | Emmendoerfer | B67D 1/07 | 222/129 |
| 10,155,647 | B2 * | 12/2018 | Foster | B67D 1/0029 | |
| 2018/0339894 | A1 * | 11/2018 | Chu | B67D 1/0859 | |
| 2023/0138611 | A1 * | 5/2023 | Kudirka | B67D 1/16 | 222/52 |

FOREIGN PATENT DOCUMENTS

| | | |
|---|---|---|
| WO | WO 2018/131028 A1 | 7/2018 |
| WO | WO 2020/031097 A1 | 2/2020 |

* cited by examiner

SECTION A-A

DETAIL B

FLAVOR INFUSION DISPENSER

CROSS-REFERENCE TO RELATED APPLICATION

This application claims the benefit of U.S. Provisional Patent Application No. 63/237,391, filed on Aug. 26, 2021, which is incorporated herein by reference in its entirety.

TECHNICAL FIELD

The present disclosure relates generally to a beverage dispenser, and more particularly to a beverage dispenser configured to infuse flavoring into a beverage.

BACKGROUND

Flavored beverages have become increasingly popular in recent years, however many flavored beverages are prepackaged, rather than being customizable. Beverage dispensing systems that do provide for customizable flavoring of beverages suffer from a number of drawbacks, such as the number of flavors that may be provided, insufficient mixing of the flavor with the beverage, and cross contamination in systems that provide multiple flavors, for example. Therefore, a flavored beverage dispenser is needed that may address one or more of the above drawbacks.

SUMMARY

According to an aspect of one or more exemplary embodiments, a flavor infusion dispenser is provided. The flavor infusion dispenser may include a refrigeration unit configured to store a beverage container, a beverage tower coupled to the refrigeration unit and configured to transport a beverage from the beverage container, a faucet coupled to the beverage tower and configured to activate flow of the beverage from the beverage container through the beverage tower, a nozzle coupled to the faucet, at least one flavor line coupled to the nozzle and configured to transport flavoring from a flavor container, and a pump configured to pump flavoring from the flavor container to the nozzle via the at least one flavor line. The nozzle may be configured to mix the beverage and the flavoring, and dispense a flavored beverage.

The at least one flavor container may include a plurality of flavor containers, and the at least one flavor line may include a plurality of flavor lines configured to be respectively coupled to the plurality of flavor containers. The flavor infusion dispenser may also include a flavor selection switch configured to receive a flavor selection input. The pump may be configured to pump flavoring from a selected flavor container of the plurality of flavor containers based on the flavor selection input.

The faucet may include a switch configured to activate the pump to pump flavoring from the at least one flavor container based on a position of the handle. The switch may be configured to activate the pump to pump flavoring from the at least one flavor container when the handle is actuated to activate the flow of the beverage from the beverage container. The switch may be configured to de-activate the pump to stop pumping flavoring from the flavor container when the handle reaches a first position, and the faucet may be configured to continue dispensing the beverage when the handle is in the first position. The switch may be a non-contact magnetic switch.

The faucet may be configured to dispense the beverage from the nozzle when the handle is moved from a starting position to a first position, and the switch may be configured to activate the pump to pump flavoring from the flavor container when the handle is moved from the first position to a second position. The switch may be configured to de-activate the pump to stop pumping flavoring from the flavor container when the handle is moved from the second position to the first position, and the faucet may be configured to continue dispensing the beverage when the handle is in the first position. Each of the at least one flavor line may include a check valve configured to prevent the beverage from entering the flavor line. The flavor infusion dispenser may also include a manifold configured to couple the beverage tower to the refrigeration unit, and to receive the at least one flavor line.

According to another aspect of one or more exemplary embodiments, there is provided a faucet for infusing flavoring into a beverage and dispensing a flavored beverage. The faucet may include a beverage inlet configured to receive the beverage, a handle configured to activate flow of the beverage into the beverage inlet, a nozzle configured to receive the beverage from the beverage inlet and the flavoring, mix the beverage and the flavoring to generate the flavored beverage, and output the flavored beverage, and a switch configured to activate and deactivate the flow of the flavoring into the nozzle based on a position of the handle. The nozzle may be configured to output the beverage after the switch deactivates the flow of the flavoring into the nozzle.

The nozzle may be configured to output the beverage when the handle is moved from a start position to a first position. The switch may be configured to activate the flow of the flavoring when the handle is in a second position, and deactivate the flow of the flavoring when the handle is returned to the first position. The nozzle may be configured to stop outputting the beverage when the handle is moved from the first position to the start position.

The nozzle may be configured to output the beverage when the handle is moved from a start position to a first position, and the switch may be configured to activate the flow of the flavoring when the handle is in a second position. The switch may be configured to deactivate the flow of the flavoring when the handle is in a third position that is between the first position and the second position. The switch may be configured to activate the flow of the flavoring, and the nozzle may be configured to output the flavored beverage, when the handle is moved from a start position to a first position. The switch may be configured to deactivate the flow of the flavoring when the handle is moved to a second position between the start position and the first position. The nozzle may be configured to output the beverage when the handle is in the second position.

DETAILED DESCRIPTION OF EXEMPLARY EMBODIMENTS

Figure 1:
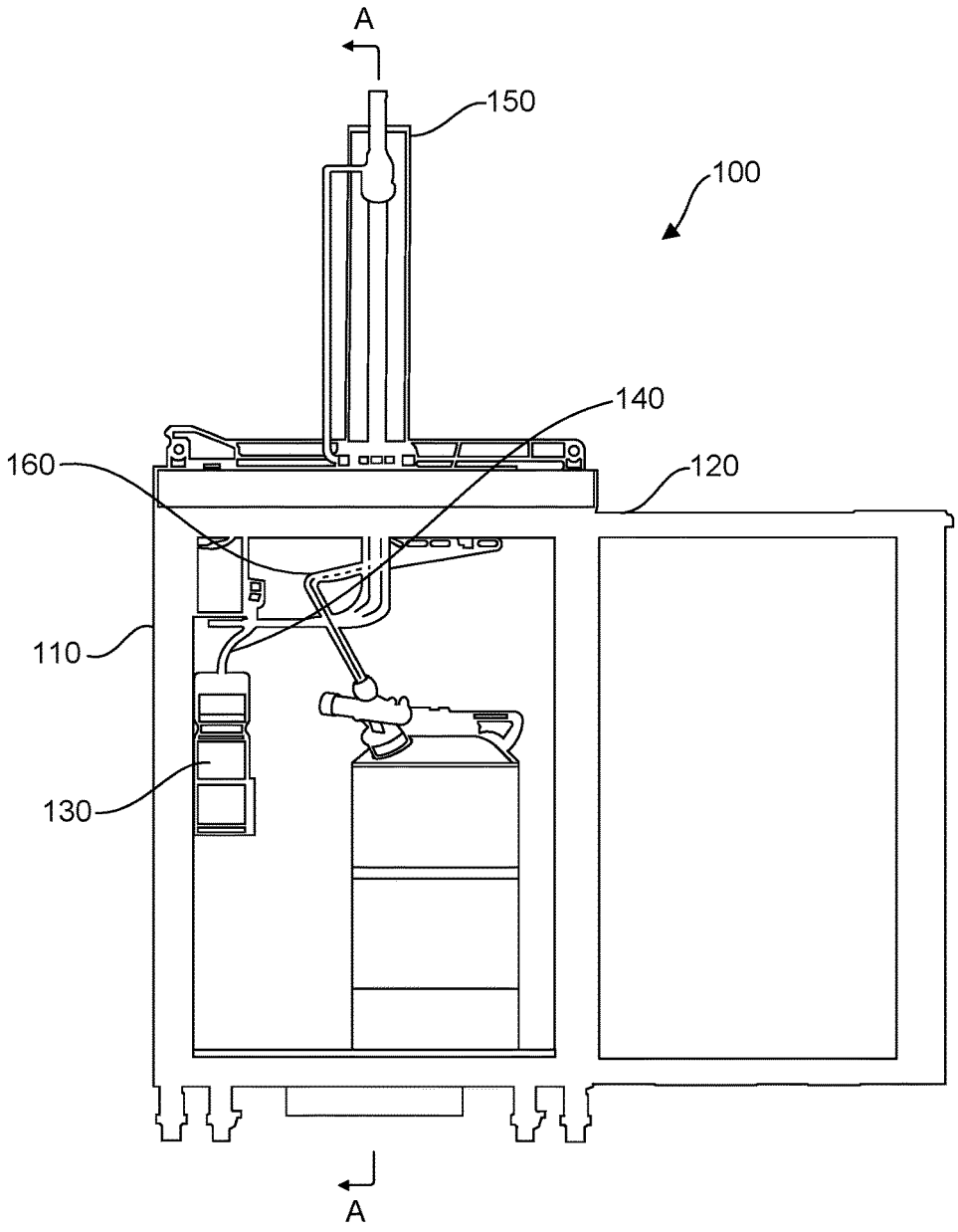
FIG. 1 shows a flavor infusion dispenser according to an exemplary embodiment.

Reference will now be made in detail to the following exemplary embodiments, which are illustrated in the accompanying drawings, wherein like reference numerals refer to like elements throughout. The exemplary embodiments may be embodied in various forms without being limited to the exemplary embodiments set forth herein. Descriptions of well-known parts are omitted for clarity.

Figure 4:
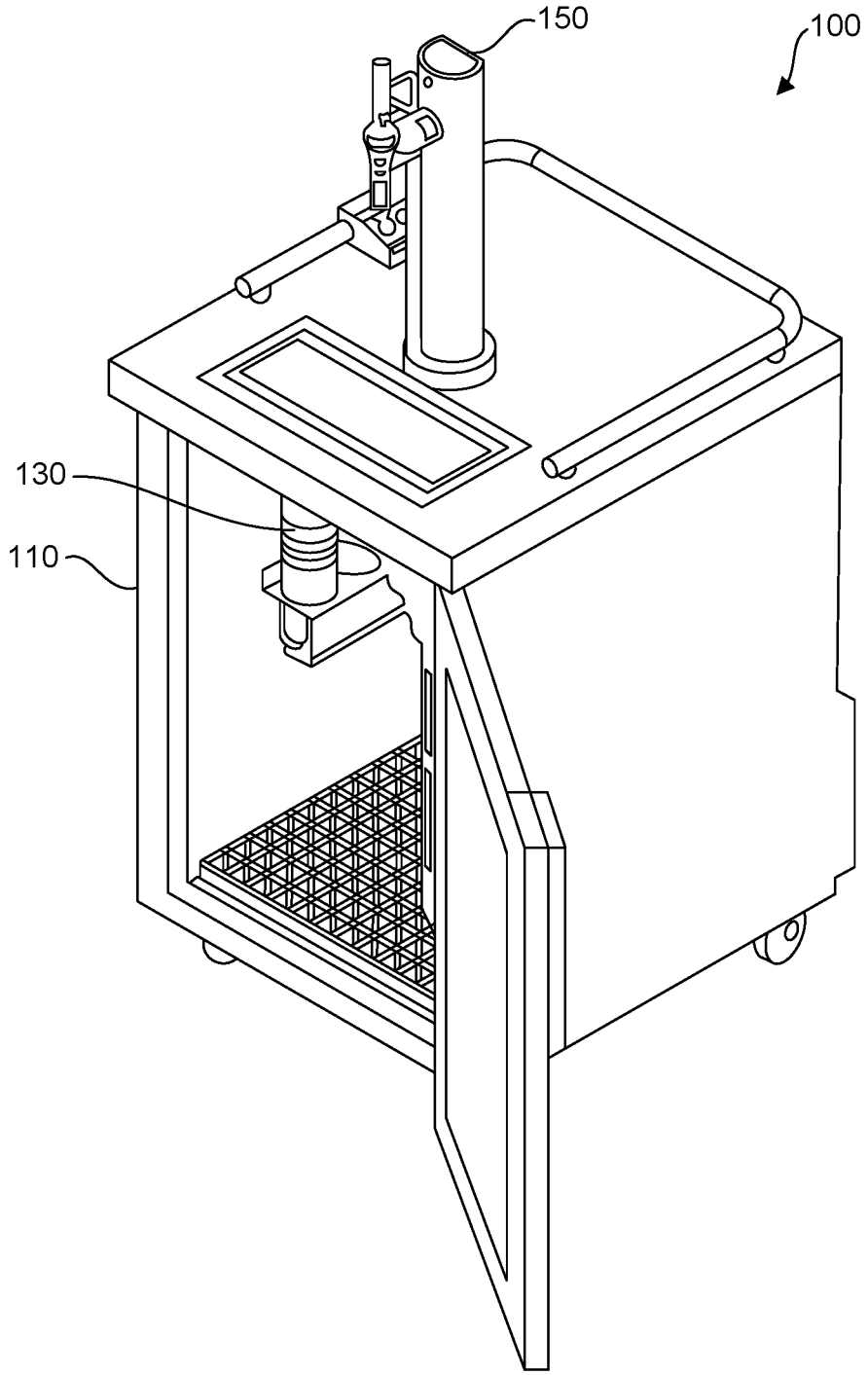
FIG. 4 shows a perspective view of a flavor infusion dispenser according to an exemplary embodiment.

FIG. 1 shows a front view and FIG. 4 shows a perspective view of a flavor infusion dispenser 100 according to an exemplary embodiment. The flavor infusion dispenser of FIGS. 1 and 4 may include a refrigeration unit 110 that is configured to store a beverage container 120, such as a keg, containing a beverage. For example, the keg may include beer, but any other type of beverage may be used. The flavor infusion dispenser 100 may also include a plurality of flavor containers 130, each storing a flavoring to be infused into the beverage contained in the beverage container 120. For example, the flavor containers 130 may store liquid flavor concentrate. Each of the plurality of flavor containers 130 may be coupled to a flavor line 140 that is configured to transport the flavoring from the flavor containers 130. The flavor infusion dispenser 100 may include a tower 150 that is coupled to the refrigeration unit 110. The tower may be configured to receive one or more beverage lines 160 that are configured to transport a beverage from the beverage container 120.

Figure 2:
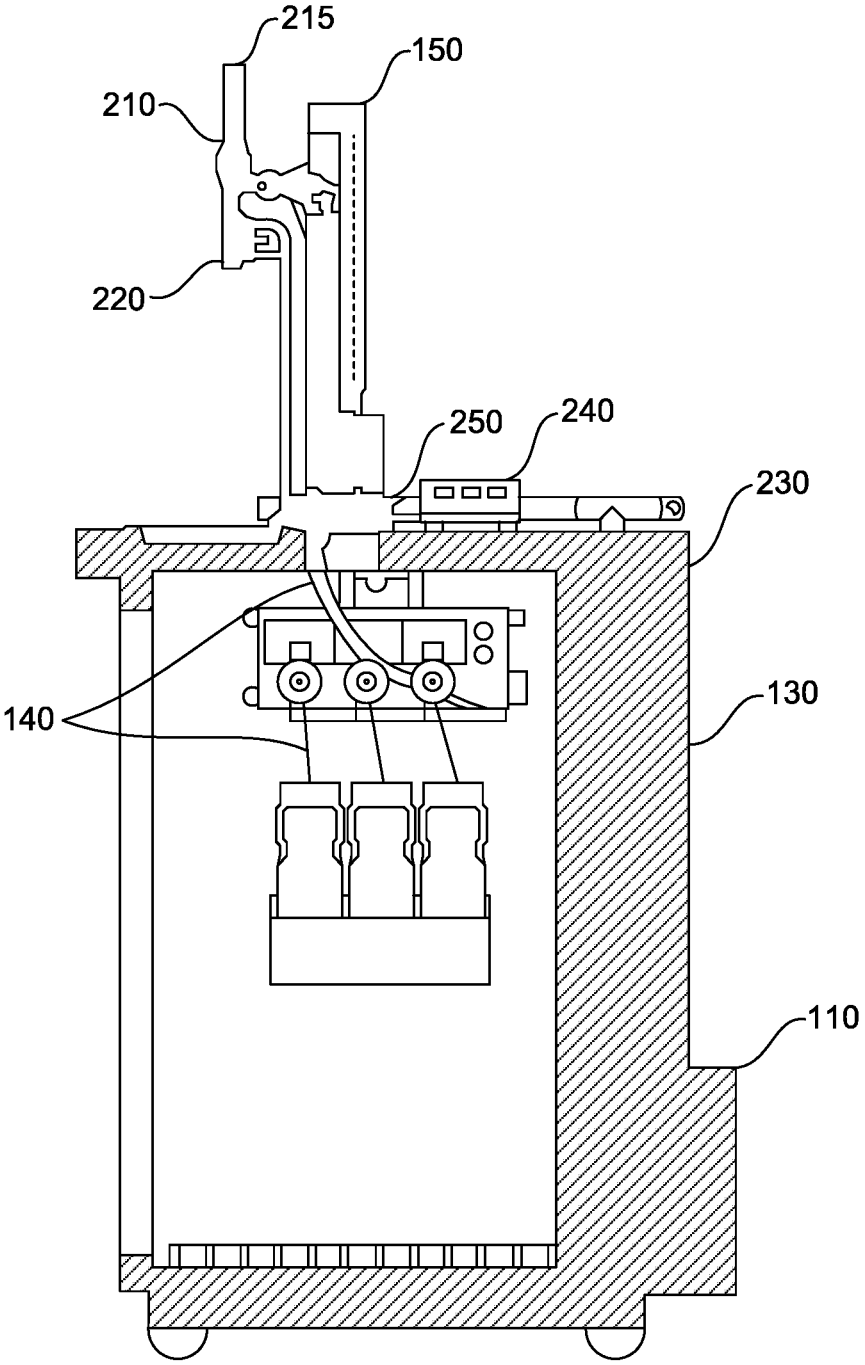
FIG. 2 shows a cross-section view of a flavor infusion dispenser according to an exemplary embodiment.

FIG. 2 shows a cross-section view of the flavor infusion dispenser 100 shown in FIG. 1 taken along line A-A. As shown in FIG. 2, a faucet 210 may be coupled to the tower 150, and may be configured to control the flow of the beverage from the beverage container 120, through the beverage lines 160 running through the tower 150, and through the faucet 160. For example, the faucet 210 may have a handle 215 that, when actuated, causes the beverage to flow from the beverage container 120 through the beverage lines 160. The faucet 210 is coupled to a nozzle 220 that is configured to output the beverage.

The flavor infusion dispenser 100 may also include a pump 230 that is coupled to the plurality of flavor containers 130 and is configured to pump flavoring from the plurality of flavor containers 130 through the flavor lines 140. According to an exemplary embodiment, the pump 230 may be a peristaltic pump, however other types of pumps may be used. The flavor infusion dispenser 100 may include a flavor selection switch 240 that is configured to receive a flavor selection input. For example, the flavor selection switch 240 may be a manual switch that can be actuated by a user to select between a plurality of flavors. Alternatively, the flavor selection switch 240 may be an electronic switch, and may include, for example, a capacitive touch screen that is configured to display a plurality of available flavor options and receive a flavor selection input based on the user's touching of a particular portion of the capacitive touch screen corresponding to a displayed available flavor option. The flavor selection switch 240 may be coupled to the pump 230 and configured to select a flavor container from the plurality of flavor containers 130 from which flavoring is to be pumped based on the received flavor selection input. The flavor selection switch 240 advantageously allows for multiple flavored beverages to be provided using a single dispenser and single beverage container 120.

The flavor infusion dispenser 100 may include a manifold 250 that is configured to couple the tower 150 to the refrigeration unit 110. The manifold 250 may be shaped to surround the outer perimeter of the tower 150, and may be configured to receive the plurality of flavor lines 140. For example, the manifold 250 may include one or more holes through which the flavor lines 140 may pass so the plurality of flavor lines 140 can be coupled to the nozzle 220, as explained below.

Figure 3:
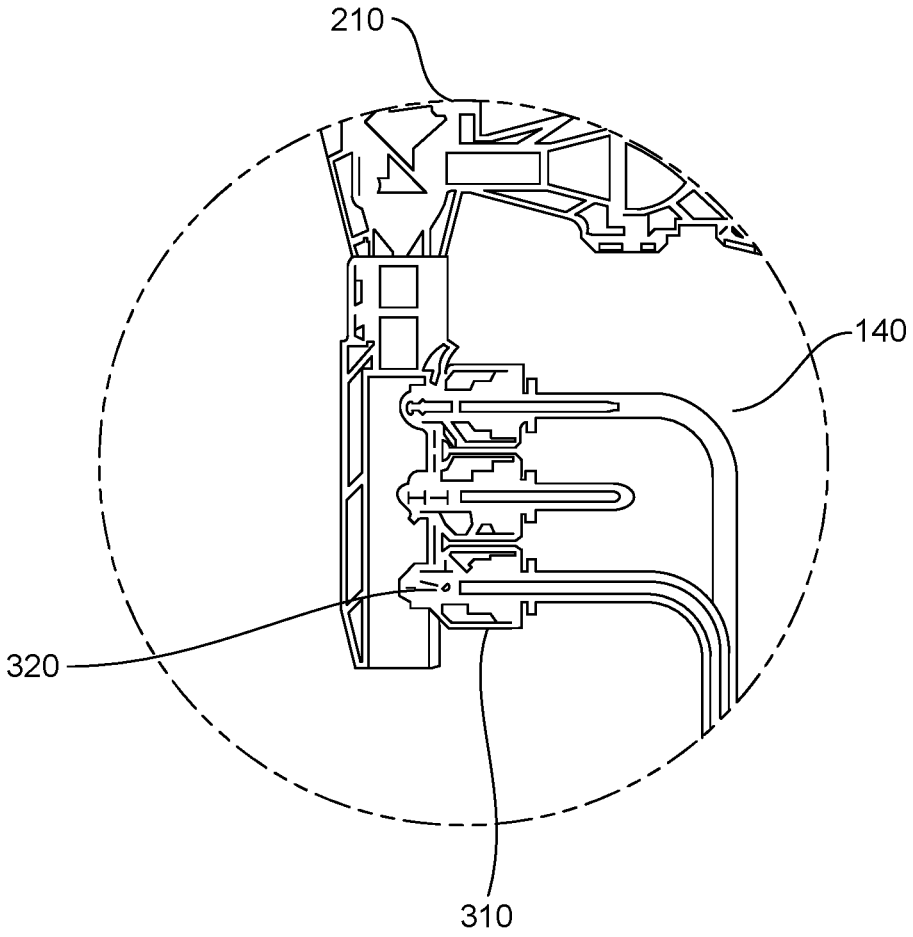
FIG. 3 shows an enlarged view of a faucet and nozzle of a flavor infusion dispenser according to an exemplary embodiment.

FIG. 3 shows an enlarged view of a nozzle 220 of a flavor infusion dispenser 100 according to an exemplary embodiment. As shown in FIG. 3, the plurality of flavor lines 140 are coupled to the nozzle 220 to supply a selected flavoring from one of the plurality of flavor containers 130. As the beverage is supplied to the nozzle 220 (from above in FIG. 3), the selected flavoring is supplied to the nozzle 220 so that the beverage and the flavoring are mixed in the nozzle 220 prior to dispensing from the bottom of the nozzle 220. Each of the plurality of flavor lines 140 may be coupled to the nozzle 220 by a quick connect or push-to-connect coupling 310, which may include a check valve 320 that is configured to prevent backflow of the beverage into the plurality of flavor lines 140. By coupling the plurality of flavor lines 140 at the nozzle 220, improved mixing of the flavoring with the beverage may be achieved as compared with mixing in the glass after dispensing.

In addition, the faucet 210 may include a switch (not shown) that is configured to control the operation of the pump 230 in response to actuation of the handle 215. For example, the switch may be a non-contact magnetic switch, however other types of switches may be used. The switch may be configured to activate the pump 230 to pump flavoring from a selected flavor container 130 upon the handle 215 being actuated to a certain position. For example, the handle 215 may be partially actuated from a starting position to a first position in order to trigger the flow of the beverage from the beverage container 120. As the handle 215 is further actuated to a second position, the switch may activate the pump 230 to begin pumping flavoring from the selected flavor container 130. When the user wishes to stop the flow of the beverage, the handle 215 is returned to its starting position. As the handle 215 is returned to its starting position, the handle 215 reaches the first position again, at which point the switch may cause the pump 230 to stop pumping flavoring from the selected flavor container 130. Alternatively, the handle position at which the pump 230 stops pumping flavoring from the selected flavor container 130 may be different from the handle position at which the pump 230 starts pumping flavoring from the selected flavor container 130. For example, the handle 215 may be actuated to a first position to activate the flow of beverage from the beverage container 120, and then further actuated to a second position to activate the pump 230 to begin pumping flavoring from the selected flavor container 130. The handle 215 may then be actuated to a third position, which may be located between the first and second positions, at which point the pump 230 may be configured to stop pumping flavoring from the selected flavor container 130. Alternatively, the pump 230 may be configured to stop pumping flavoring from the selected flavor container 130 when the handle 215 is no longer in the second position, i.e., as soon as the handle 215 begins to move back toward the starting position. According to yet another alternative, the switch may be configured to activate the pump 230 to pump flavoring from the selected flavor container 130 when the handle 215 is in the first position, so that both the beverage and the flavoring are dispensed when the handle 215 is moved from the starting position to the first position.

According to an exemplary embodiment, the first or third position may still allow the beverage to flow from the beverage container 120 and dispense from the nozzle 220, even though the pump 230 has been deactivated by the switch. Accordingly, the beverage that flows after the pump 230 has stopped pumping the flavoring from the flavor containers 130 may flush any flavoring remaining in the nozzle 220 so that the selected flavoring does not contaminate the next beverage to be dispensed. For example, if an orange flavor has been selected at the flavor selection switch 240, actuating the handle 215 from a starting position to the first position may cause the beverage to be dispensed from the nozzle 220, and further actuating the handle 215 to the second position may cause the pump 230 to begin pumping orange flavoring from an orange flavor container to mix with the beverage (e.g., beer) and be dispensed into a glass. As the glass is nearly full, the handle 215 may be returned to the starting position, but before reaching the starting position the handle 215 reaches the first position again (or a third position between the first and second positions), at which the switch may deactivate the pump 230. While the handle 215 is at the first (or third) position, the beverage may still be dispensed from the nozzle 220, flushing any remaining orange flavoring remaining in the nozzle 220. When the handle 215 reaches the starting position, the beverage is no longer dispensed. If a lime flavor is subsequently selected, the process repeats to provide lime flavoring to the beverage. However, because the previous pour flushed the remaining orange flavoring from the nozzle 220, the subsequent pour, in which the lime flavor was selected, may not be contaminated with unwanted orange flavoring.

Although the inventive concepts of the present disclosure have been described and illustrated with respect to exemplary embodiments thereof, it is not limited to the exemplary embodiments disclosed herein and modifications may be made therein without departing from the scope of the inventive concepts.

What is claimed is:

1. A flavor infusion dispenser comprising:
- a refrigeration unit configured to store a beverage container;
- a beverage tower coupled to the refrigeration unit and configured to transport a beverage from the beverage container;
- a faucet coupled to the beverage tower and having a handle configured to activate flow of the beverage from the beverage container through the beverage tower;
- a nozzle coupled to the faucet;
- at least one flavor container configured to store flavoring for the beverage;
- at least one flavor line coupled to the nozzle and configured to transport flavoring from the at least one flavor container;
- a pump configured to pump flavoring from the at least one flavor container to the nozzle via the at least one flavor line;
- wherein the nozzle is configured to mix the beverage and the flavoring and dispense a flavored beverage;
- wherein the faucet comprises a switch configured to activate the pump to pump flavoring from the at least one flavor container based on a position of the handle;
- wherein the switch is configured to de-activate the pump to stop pumping flavoring from the flavor container when the handle reaches a first position; and
- wherein the faucet is configured to continue dispensing the beverage when the handle is in the first position.

2. The flavor infusion dispenser according to claim 1, wherein the at least one flavor container comprises a plurality of flavor containers, and the at least one flavor line comprises a plurality of flavor lines configured to be respectively coupled to the plurality of flavor containers;
- wherein said flavor infusion dispenser further comprises a flavor selection switch configured to receive a flavor selection input; and
- wherein said pump is configured to pump flavoring from a selected flavor container of the plurality of flavor containers based on the flavor selection input.

3. The flavor infusion dispenser according to claim 1, wherein the switch is configured to activate the pump to pump flavoring from the at least one flavor container when the handle is actuated to activate the flow of the beverage from the beverage container.

4. The flavor infusion dispenser according to claim 1, wherein the switch is a non-contact magnetic switch.

5. The flavor infusion dispenser according to claim 1, wherein each of the at least one flavor line includes a check valve configured to prevent the beverage from entering the flavor line.

6. The flavor infusion dispenser according to claim 1, further comprising a manifold configured to couple the beverage tower to the refrigeration unit, and to receive the at least one flavor line.

7. A flavor infusion dispenser comprising:
- a refrigeration unit configured to store a beverage container;
- a beverage tower coupled to the refrigeration unit and configured to transport a beverage from the beverage container;
- a faucet coupled to the beverage tower and having a handle configured to activate flow of the beverage from the beverage container through the beverage tower;
- a nozzle coupled to the faucet
- at least one flavor container configured to store flavoring for the beverage;
- at least one flavor line coupled to the nozzle and configured to transport flavoring from the at least one flavor container;
- a pump configured to pump flavoring from the at least one flavor container to the nozzle via the at least one flavor line;
- wherein the nozzle is configured to mix the beverage and the flavoring and dispense a flavored beverage;
- wherein the faucet comprises a switch configured to activate the pump to pump flavoring from the at least one flavor container based on a position of the handle;
- wherein the faucet is configured to dispense the beverage from the nozzle when the handle is moved from a starting position to a first position; and
- wherein the switch is configured to activate the pump to pump flavoring from the flavor container when the handle is moved from the first position to a second position.

8. The flavor infusion dispenser according to claim 7, wherein the switch is configured to de-activate the pump to stop pumping flavoring from the flavor container when the handle is moved from the second position to the first position; and
- wherein the faucet is configured to continue dispensing the beverage when the handle is in the first position.

9. The flavor infusion dispenser according to claim 7, wherein the switch is a non-contact magnetic switch.

10. A faucet for infusing flavoring into a beverage and dispensing a flavored beverage, the faucet comprising:
- a beverage inlet configured to receive the beverage;
- a handle configured to activate flow of the beverage into the beverage inlet;
- a nozzle configured to receive the beverage from the beverage inlet and the flavoring, mix the beverage and the flavoring to generate the flavored beverage, and output the flavored beverage; and a switch configured to activate and deactivate the flow of the flavoring into the nozzle based on a position of the handle;

wherein the nozzle is configured to output the beverage after the switch deactivates the flow of the flavoring into the nozzle; and wherein the nozzle is configured to output the beverage when the handle is moved from a start position to a first position, wherein the switch is configured to activate the flow of the flavoring when the handle is in a second position, and wherein the switch is configured to deactivate the flow of the flavoring when the handle is returned to the first position.

11. The faucet of claim 10, wherein the nozzle is configured to stop outputting the beverage when the handle is moved from the first position to the start position.

12. A faucet for infusing flavoring into a beverage and dispensing a flavored beverage, the faucet comprising:

a beverage inlet configured to receive the beverage;

a handle configured to activate flow of the beverage into the beverage inlet a nozzle configured to receive the beverage from the beverage inlet and the flavoring, mix the beverage and the flavoring to generate the flavored beverage, and output the flavored beverage; and a switch configured to activate and deactivate the flow of the flavoring into the nozzle based on a position of the handle;

wherein the nozzle is configured to output the beverage after the switch deactivates the flow of the flavoring into the nozzle; and wherein the nozzle is configured to output the beverage when the handle is moved from a start position to a first position, wherein the switch is configured to activate the flow of the flavoring when the handle is in a second position, and wherein the switch is configured to deactivate the flow of the flavoring when the handle is in a third position that is between the first position and the second position.

13. A faucet for infusing flavoring into a beverage and dispensing a flavored beverage, the faucet comprising:

a beverage inlet configured to receive the beverage;

a handle configured to activate flow of the beverage into the beverage inlet;

a nozzle configured to receive the beverage from the beverage inlet and the flavoring, mix the beverage and the flavoring to generate the flavored beverage, and output the flavored beverage; and a switch configured to activate and deactivate the flow of the flavoring into the nozzle based on a position of the handle;

wherein the nozzle is configured to output the beverage after the switch deactivates the flow of the flavoring into the nozzle;

wherein the switch is configured to activate the flow of the flavoring, and the nozzle is configured to output the flavored beverage, when the handle is moved from a start position to a first position; and wherein the switch is configured to deactivate the flow of the flavoring when the handle is moved to a second position between the start position and the first position.

14. The faucet of claim 13, wherein the nozzle is configured to output the beverage when the handle is in the second position.

* * * * *